US007028499B2

(12) United States Patent
Kwon et al.

(10) Patent No.: US 7,028,499 B2
(45) Date of Patent: Apr. 18, 2006

(54) REFRIGERATOR WITH AN EVAPORATOR

(75) Inventors: Jun-hyoun Kwon, Seoul (KR); Jae-seung Lee, Suwon (KR); Chang-nyeun Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/263,760

(22) Filed: Oct. 4, 2002

(65) Prior Publication Data

US 2003/0177772 A1 Sep. 25, 2003

(30) Foreign Application Priority Data

Mar. 20, 2002 (KR) ..... 2002-15175

(51) Int. Cl.
*F25D 21/08* (2006.01)

(52) U.S. Cl. ..... 62/276; 62/80

(58) Field of Classification Search ..... 62/275, 62/276, 277, 278, 283, 196.1, 197, 196.4, 62/324.5, 80, 81

See application file for complete search history.

(56) References Cited

U.S. PATENT DOCUMENTS

| | | | | |
|---|---|---|---|---|
| 1,970,340 | A * | 8/1934 | Ruff | 62/81 |
| 2,487,662 | A | 11/1949 | McCloy | |
| 2,630,685 | A | 3/1953 | Lewis | |
| 2,654,226 | A | 10/1953 | Duncan et al. | |
| 2,687,626 | A * | 8/1954 | Bartlowe | 62/276 |
| 2,701,455 | A * | 2/1955 | Kleist | 62/278 |
| 2,709,345 | A * | 5/1955 | Ramsey | 62/275 |
| 2,773,363 | A | 12/1956 | William, Jr. | |
| 2,928,258 | A * | 3/1960 | Mann et al. | 62/276 |
| 3,224,216 | A * | 12/1965 | Crouch | 62/140 |
| 5,339,644 | A * | 8/1994 | Singh | 62/234 |

FOREIGN PATENT DOCUMENTS

| | | |
|---|---|---|
| CH | 210126 | 6/1940 |
| DE | 1963931 | 1/1971 |
| DE | 3808230 | 9/1989 |
| EP | 0 838 644 | 4/1998 |
| JP | 62-37657 | 2/1987 |
| JP | 5-73484 | 10/1993 |
| JP | 7-318229 | 12/1995 |
| KR | 97-11692 | 3/1997 |
| KR | 1997-4344 | 3/1997 |
| KR | 10-216956 | 6/1999 |

OTHER PUBLICATIONS

Japanese Office Action; Dated: Aug. 17, 2004.
European Search Report for EP 02 25 7342, issued Jul. 28, 2003.

* cited by examiner

*Primary Examiner*—Harry B. Tanner
(74) *Attorney, Agent, or Firm*—Staas & Halsey LLP

(57) ABSTRACT

A refrigerator with an evaporator having a refrigerant pipe, and a defrosting heater placed below the evaporator and defrosting the evaporator, wherein the refrigerant pipe includes a main refrigerant pipe evaporating a refrigerant, and a heat-transfer refrigerant pipe extended from a lower part of the main refrigerant pipe so as to exchange heat, and disposed adjacent to the defrosting heater. Therefore, the refrigerator can defrost an evaporator quickly and uniformly.

8 Claims, 4 Drawing Sheets

REFRIGERATOR WITH AN EVAPORATOR

CROSS-REFERENCE TO RELATED APPLICATIONS

This application claims the benefit of Korean Application No. 02-15175, filed Mar. 20, 2002, in the Korean Industrial Property Office, the disclosure of which is incorporated herein by reference.

BACKGROUND OF THE INVENTION

1. Field of the Invention

The present invention relates to a refrigerator which can defrost an evaporator quickly and uniformly.

2. Description of the Related Art

Generally, a refrigerator comprises an evaporator evaporating a refrigerant. The evaporator includes a refrigerant pipe in which the refrigerant flows, and the refrigerant pipe is provided in a zigzag formation from the upper part to the lower part of the evaporator, returning to the upper part from the lower part of the evaporator in a zigzag shape. Further, the refrigerant pipe is combined with a cooling fin in order to increase effectiveness of the heat exchange.

In the conventional evaporator, in order to defrost the evaporator, there is provided a heater pipe having a defrosting heater. Herein, the heater pipe is regularly arranged on the surface of the cooling fin.

Further, in the lower part of the evaporator is provided a defrosting sensor sensing a temperature of the evaporator and turning off the defrosting heater depending on the temperature sensed.

With this configuration, in the refrigerator, the defrosting heater is turned on at regular intervals, thereby defrosting the evaporator.

However, in the conventional refrigerator, when the defrosting heater is turned on, air around the cooling fin is heated by the defrosting heater arranged on the surface of the cooling fin, and high-temperature air starts defrosting the upper part of the evaporator before defrosting the lower part because the high-temperature air ascends. Therefore, there are problems in that the evaporator is not uniformly defrosted, and it takes a long time to defrost the evaporator completely considering the lower part thereof. Moreover, about the time when the lower part of the evaporator is defrosted, temperature of the upper part of the evaporator is rather high, and that makes the temperature of an upper part of the refrigerator also high. If the temperature of the upper part of the refrigerator rises enough to affect a set temperature of the inner part of the refrigerator, the food kept in the refrigerator may go bad.

SUMMARY OF THE INVENTION

Accordingly, it is an object of the present invention to provide a refrigerator which can defrost an evaporator quickly and uniformly.

Additional objects and advantages of the invention will be set forth in part in the description which follows and, in part, will be obvious from the description, or may be learned by practice of the invention.

The above and other objects of the present invention may be accomplished by the provision of a refrigerator comprising: an evaporator having a refrigerant pipe; and a defrosting heater placed below the evaporator and defrosting the evaporator, wherein the refrigerant pipe includes a main refrigerant pipe evaporating a refrigerant, and a heat-transfer refrigerant pipe extending from a lower part of the main refrigerant pipe to exchange heat, and disposed adjacent to the defrosting heater.

In an aspect of the present invention, the heat-transfer refrigerant pipe is provided between an upstream section and a downstream section of the main refrigerant pipe.

In another aspect of the present invention, the heat-transfer refrigerant pipe branches off from the main refrigerant pipe and is returned to the main refrigerant pipe.

In yet another aspect of the present invention, the refrigerator further comprises a heat-transfer member contacting a lower part of the heat-transfer refrigerant pipe and helping heat to be effectively transferred from the defrosting heater to the refrigerant pipe.

In yet another aspect of the present invention, the refrigerator further comprises: a bypass pipe through which the refrigerant of the evaporator is bypassed; and a bypass valve formed in the bypass pipe, valving the refrigerant flowing in the bypass pipe.

In yet another aspect of the present invention, the refrigerator further comprises a pressure regulating valve formed in at least one of an inlet and an outlet of the evaporator, and regulating the pressure of the refrigerant in the evaporator.

BRIEF DESCRIPTION OF THE DRAWINGS

These and other objects and advantages of the invention will become apparent and more readily appreciated from the following description of the embodiments, taken in conjunction with the accompanying drawings of which.

DETAILED DESCRIPTION OF THE PREFERRED EMBODIMENT

Figure 1:
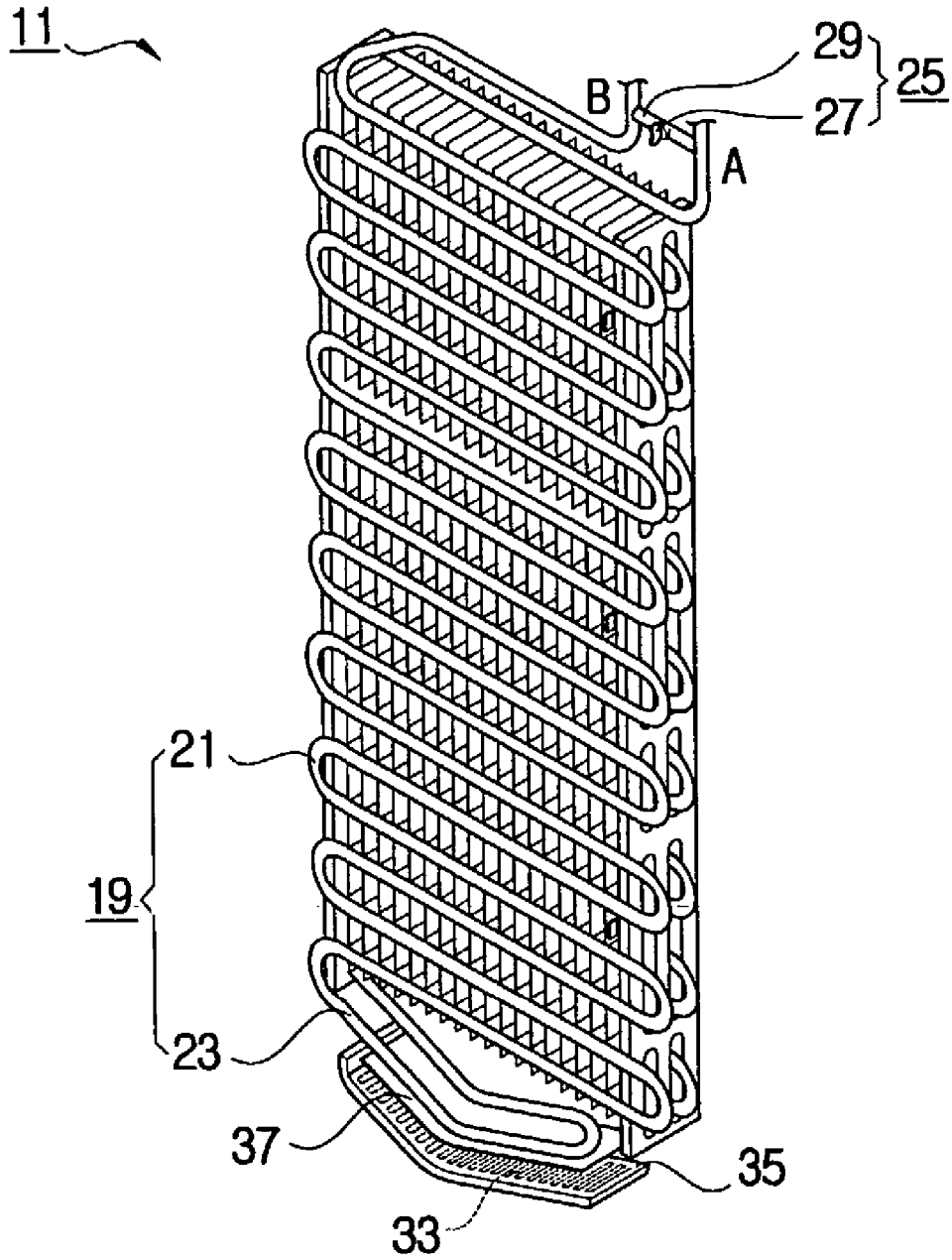
FIG. 1 is a perspective view of an evaporator according to an embodiment of the present invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 2:
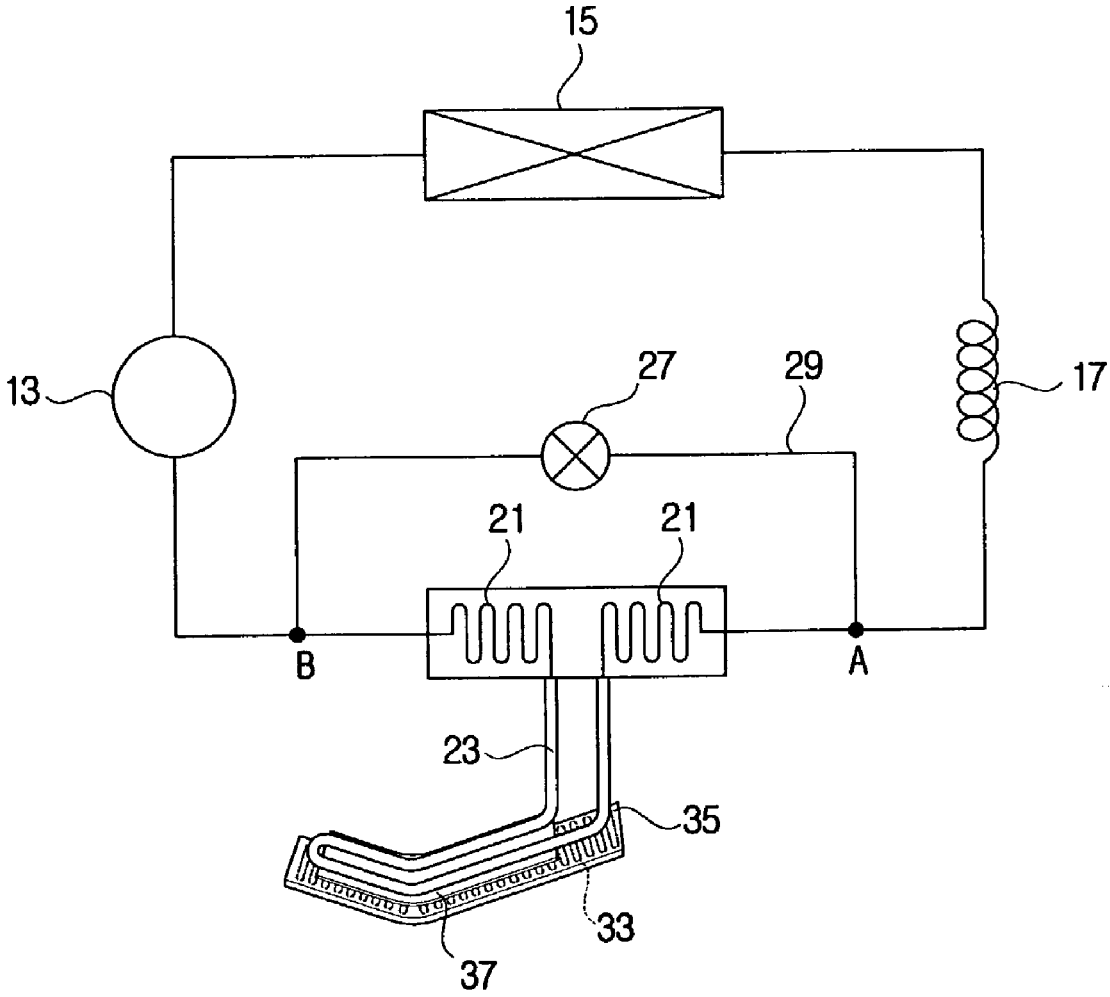
FIG. 2 illustrates circulation of a refrigerant in a refrigerator according to the embodiment of FIG. 1.

FIG. 1 is a perspective view of an evaporator according to an embodiment of the present invention, and FIG. 2 illustrates circulation of a refrigerant in a refrigerator according to the embodiment of FIG. 1. The refrigerator freezes and refrigerates food by circulating a refrigerant according to a refrigeration cycle. As illustrated in FIG. 2, in the refrigerator according to the embodiment of FIG. 1, the refrigeration cycle comprises a compressor 13 compressing the refrigerant, a condenser 15 condensing the refrigerant compressed by the compressor 13, a capillary tube 17 expanding the refrigerant condensed by the condenser 15, and an evaporator 11 evaporating the refrigerant expanded by the capillary tube 17.

On the other hand, the evaporator 11 includes a refrigerant pipe 19 in which the refrigerant flows, and the refrigerant pipe 19 is provided with an inlet "A" through which the refrigerant flows into the evaporator 11 and an outlet "B" through which the refrigerant flows from the evaporator 11.

The refrigerant pipe 19 comprises a main refrigerant pipe 21 evaporating the refrigerant, and a heat-transfer refrigerant pipe 23 to be heated by a defrosting heater 33 (to be described later). The main refrigerant pipe 21 is provided in a zigzag formation from the upper part to the lower part of the evaporator 11, and is sectioned into a downstream section between the inlet "A" and the heat-transfer refrigerant pipe 23 and an upstream section between the heat-transfer refrigerant pipe 23 and the outlet "B." Further, in the main refrigerant pipe 21 is provided a defrosting sensor (not shown) sensing a temperature of the evaporator 11 and transmitting information on the sensed temperature to a control part (not shown).

The heat-transfer refrigerant pipe 23 is provided between the upstream section and the downstream section of the main refrigerant pipe 21, and is adjacent to the defrosting heater 33 so as to be effectively heated by the defrosting heater 33.

Under the heat-transfer refrigerant pipe 23 is provided a heat-transfer member 37 helping heat be effectively transferred from the defrosting heater 33 to the heat-transfer refrigerant pipe 23. The heat-transfer member 37 has a plate shape made of a good heat conductive material, and is in contact with the lower part of the heat-transfer refrigerant pipe 23 so as to increase heat transfer from the defrosting heater 33 to the heat-transfer refrigerant pipe 23.

Under the heat-transfer member 37, a drain plate 35 is provided to catch water produced when the evaporator 11 is defrosted. On the back of the drain plate 35 is provided the defrosting heater 33 which is controlled by the control part to be turned on and off according to the temperature of the evaporator 11 sensed by the defrosting sensor.

Further, in the refrigerator according to this embodiment, the evaporator 11 comprises a bypass part 25 provided between the inlet "A" and the outlet "B" and bypassing some refrigerants. The bypass part 25 includes a bypass pipe 29 through which the refrigerant of the evaporator 11 is bypassed, and a bypass valve 27 formed in the bypass pipe 29, valving the refrigerant flowing in the bypass pipe 29. While the evaporator 11 is defrosted, the bypass valve 27 is opened and bypasses some refrigerants flowing in the evaporator 11, thereby equalizing the pressure in both the inlet "A" and the outlet "B". On the other hand, while the evaporator 11 is not defrosted, the bypass valve 27 closes the bypass pipe 29.

With this configuration, according to this embodiment, the process of defrosting the evaporator 11 is as follows. The defrosting heater 33 is turned on according to the temperature of the evaporator 11 sensed by the defrosting sensor, and heats the heat-transfer refrigerant pipe 23, thereby evaporating the refrigerant gathered in the heat-transfer refrigerant pipe 23. Then, the evaporated refrigerant ascends toward the upper part of the evaporator 11, and exchanges the heat with the refrigerant of the upper part of the main refrigerant pipe 21. Herein, the heat exchange is based on a thermosyphon principle that latent heat is transferred while a phase of the refrigerant is changed. According to this heat exchange, the lower part of the evaporator 11, i.e., the heat-transfer refrigerant pipe 23, exchanges heat with the main refrigerant pipe 21 by means of the refrigerant, thereby raising the temperature equally in all parts of the main refrigerant pipe 21. Thus, because the temperature is equally raised in the upper and lower parts of the evaporator 11, the evaporator 11 is defrosted quickly and uniformly. Further, the lower part of the evaporator 11 is easily defrosted, thereby preventing the lower part of the evaporator 11 from being damaged due to frost.

Figure 3:
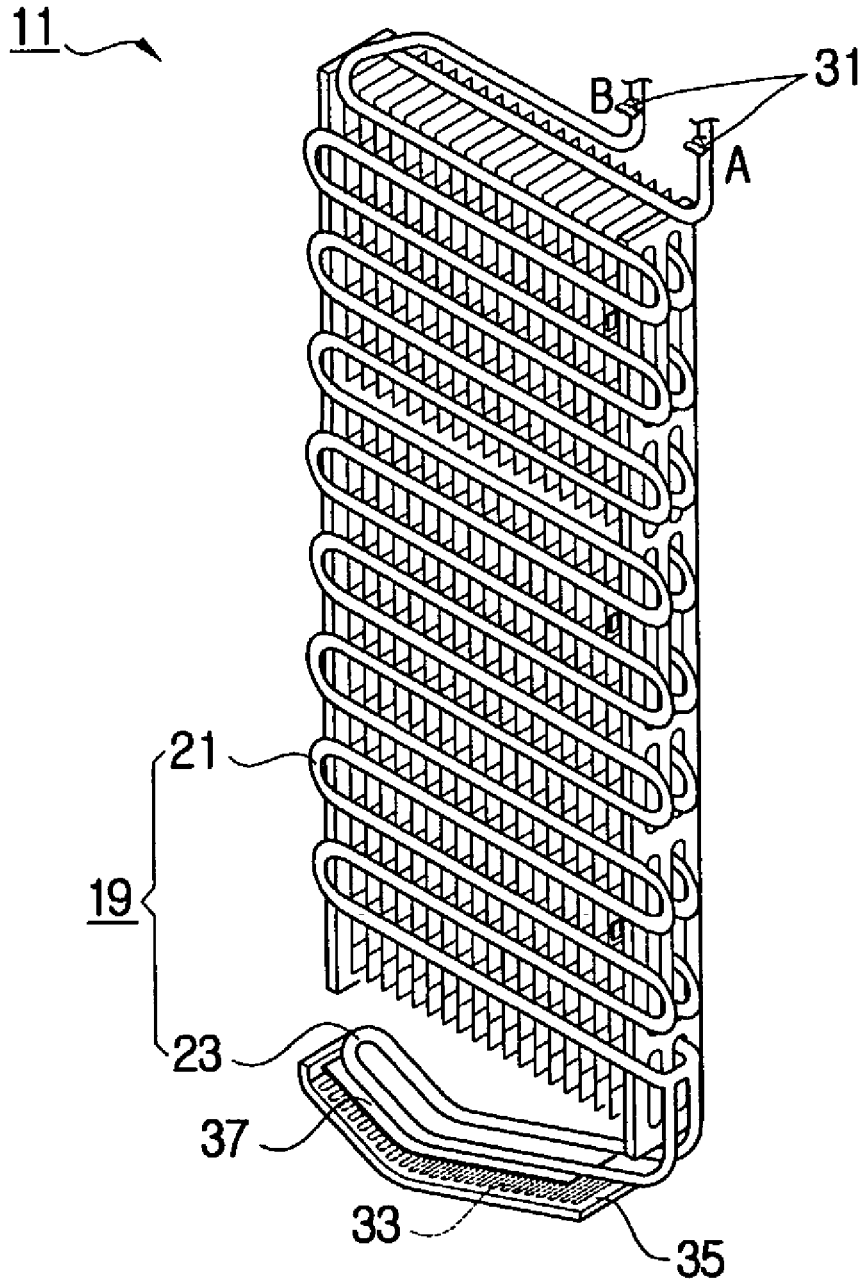
FIG. 3 is a perspective view of an evaporator according to another embodiment of the present invention.
Figure 4:
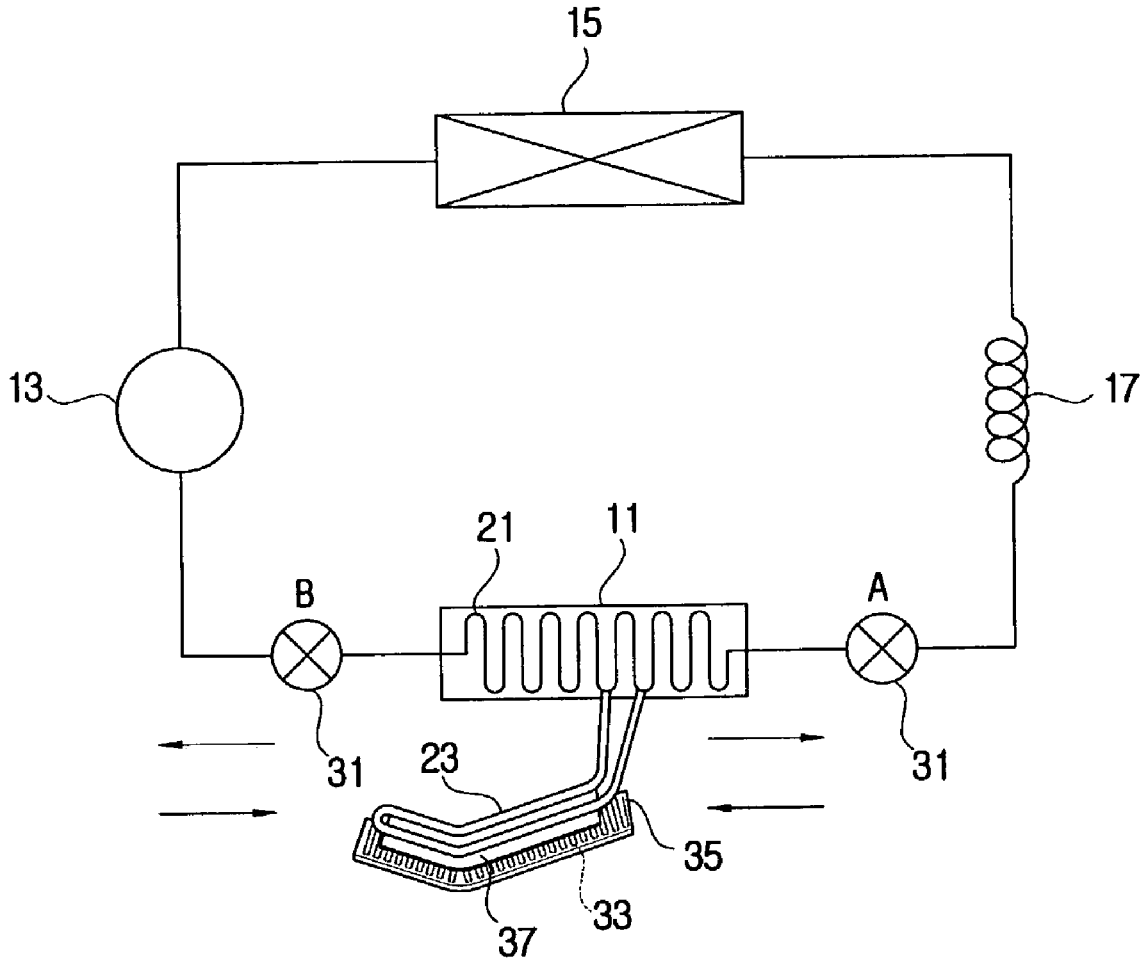
FIG. 4 illustrates circulation of a refrigerant in a refrigerator according to the embodiment of FIG. 3.

FIG. 3 is a perspective view of an evaporator according to another embodiment of the present invention, and FIG. 4 illustrates circulation of a refrigerant in a refrigerator according to the embodiment of FIG. 3. Contrary to the previous embodiment, in the refrigerator according to the embodiment of FIG. 3, the evaporator 11 comprises a pressure regulating valve 31 formed in the inlet "A" and the outlet "B". However, the evaporator 11 according to this embodiment may comprise the bypass pipe and the bypass valve to bypass the refrigerant of the evaporator 11. The pressure regulating valve 31 is closed while the evaporator 11 is defrosted, and opened while the evaporator 11 is not defrosted. Herein, the pressure regulating valve 31 prevents the refrigerant from flowing backward into the compressor 13 and the capillary tube 17.

Further, the heat-transfer refrigerant pipe 23 is not extended from the main refrigerant pipe 21, but instead branches off from the downstream section of the main refrigerant pipe 21 and returns to the main refrigerant pipe 21. Thus, while the evaporator 11 is defrosted, the pressure regulating valve 31 is closed, and the refrigerant of the heat-transfer refrigerant pipe 23 which branches off from the downstream section of the main refrigerant pipe 21 is heated. Then, the liquid refrigerant in the heat-transfer refrigerant pipe 23 exchanges heat with the refrigerant in the main refrigerant pipe 21, thereby raising the temperature equally in all parts of the main refrigerant pipe 21. Therefore, the evaporator 11 is defrosted quickly, and uniformly in the upper and lower parts thereof. Additionally, like in this embodiment, the evaporator 11 according to the previous embodiment may comprise the pressure regulating valve provided in the inlet "A" and the outlet "B" of the evaporator.

In the embodiment of FIG. 3, the evaporator 11 comprises the pressure regulating valve 31 provided in the inlet "A" and the outlet "B" and regulating the pressure of the refrigerant in the evaporator 11. However, the evaporator 11 may not comprise the pressure regulating valve.

In the above embodiments, the present invention is applied to defrost the single evaporator 11. However, the present invention may be applied to defrost a plurality of evaporators.

As described above, the present invention provides a refrigerator which can defrost an evaporator quickly and uniformly.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A refrigerator, comprising:

an evaporator having a refrigerant pipe;

a defrosting heater placed below the evaporator and defrosting the evaporator;

a bypass pipe through which refrigerant of the evaporator is bypassed; and a bypass valve formed in the bypass pipe, valving the refrigerant flowing in the bypass pipe, wherein the refrigerant pipe includes a main refrigerant pipe evaporating the refrigerant, and a heat-transfer refrigerant pipe extending from a lower part of the main refrigerant pipe to exchange heat, the heat-transfer refrigerant pipe being positioned between an upstream section and a downstream section of the main refrigerant pipe, and evaporated refrigerant heated by the defrosting heater rises toward an upper part of the evaporator through the upstream section and the downstream section of the main refrigerant pipe, and exchanges heat with refrigerant in an upper part of the main refrigerant pipe.

2. The refrigerator according to claim 1, wherein the heat-transfer refrigerant pipe branches off from the main refrigerant pipe and is returned to the main refrigerant pipe.

3. The refrigerator according to claim 1, further comprising a heat-transfer member contacting a lower part of the heat-transfer refrigerant pipe and helping heat be effectively transferred from the defrosting heater to the refrigerant pipe.

4. The refrigerator according to claim 1, wherein the refrigerant pipe comprises:

an inlet to receive refrigerant; and an outlet to exit refrigerant, wherein while the evaporator is defrosted, the bypass valve is opened and bypasses some refrigerant flowing in the evaporator between the inlet and the outlet to equalize pressure in the inlet and the outlet.

5. The refrigerator according to claim 1, wherein the bypass valve is closed when the evaporator is not defrosted.

6. The refrigerator according to claim 1, wherein the evaporated refrigerant heated by the defrosting heater exchanges heat with the refrigerant of the upper part of the refrigerant pipe based on a thermosyphon principle that latent heat is transferred while a phase of the refrigerant is changed.

7. A refrigerator having an evaporator including a refrigerant pipe, the refrigerant pipe comprising:

a defrosting heater;

a main refrigerant pipe to evaporate a refrigerant in the refrigerator;

a heat-transfer refrigerant pipe to exchange heated refrigerant with unheated refrigerant within the main refrigerant pipe, the heat-transfer refrigerant pipe positioned to exchange the heated refrigerant with the unheated refrigerant at a lower portion of the evaporator prior to exchanging the heated refrigerant with the remaining portions of the evaporator, and disposed adjacent to the defrosting heater, which is not submerged in the refrigerant;

a bypass pipe through which the refrigerant of the evaporator is bypassed; and a bypass valve formed in the bypass pipe, valving the refrigerant flowing in the bypass pipe, wherein the heated refrigerant rises toward an upper portion of the evaporator through an upstream section and a downstream section of the main refrigerant pipe, and exchanges heat with refrigerant in the upper portion of the evaporator.

8. The refrigerator according to claim 7, wherein the heat-transfer refrigerant pipe branches off from the main refrigerant pipe and is returned to the main refrigerant pipe.

* * * * *

UNITED STATES PATENT AND TRADEMARK OFFICE

CERTIFICATE OF CORRECTION

PATENT NO. : 7,028,499 B2
APPLICATION NO. : 10/263760
DATED : April 18, 2006
INVENTOR(S) : Jun-hyun Kwon et al.

It is certified that error appears in the above-identified patent and that said Letters Patent is hereby corrected as shown below:

On the cover page, item (56) References Cited, Column 2, Foreign Patent Documents:

Line 1, change “CH” to --DE--

Line 2, change “1963931” to --1936931--

Signed and Sealed this

Twenty-second Day of August, 2006

JON W. DUDAS
*Director of the United States Patent and Trademark Office*